US010109962B2

(12) United States Patent
Jenkins et al.

(10) Patent No.: US 10,109,962 B2
(45) **Date of Patent: *Oct. 23, 2018**

(54) COMMUNICATIONS CABLE WITH STATUS INDICATOR FOR ELECTRONIC DEVICES

(71) Applicant: Western Digital Technologies, Inc., Irvine, CA (US)

(72) Inventors: Dean M. Jenkins, La Canada-Flintridge, CA (US); Musa I. Kakish, Anaheim, CA (US)

(73) Assignee: Western Digital Technologies, Inc., Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/865,021

(22) Filed: Jan. 8, 2018

(65) Prior Publication Data

US 2018/0233864 A1 Aug. 16, 2018

Related U.S. Application Data

(63) Continuation of application No. 15/458,930, filed on Mar. 14, 2017, now Pat. No. 9,893,476, which is a continuation of application No. 14/277,362, filed on May 14, 2014, now Pat. No. 9,608,386.

(60) Provisional application No. 61/983,554, filed on Apr. 24, 2014.

(51) Int. Cl.
*H01R 13/717* (2006.01)

(52) U.S. Cl.
CPC ..... *H01R 13/7175* (2013.01); *H01R 13/7172* (2013.01)

(58) Field of Classification Search
CPC ..... B08B 21/18
See application file for complete search history.

(56) References Cited

U.S. PATENT DOCUMENTS

| | | | |
|---|---|---|---|
| 5,978,236 | A | 11/1999 | Faberman et al. |
| 6,361,357 | B1 | 3/2002 | Stillwell et al. |
| 6,733,333 | B1 | 5/2004 | Chen |
| 7,269,673 | B2 | 9/2007 | Kim et al. |
| 7,701,705 | B1 | 4/2010 | Szeremeta |
| 8,064,194 | B2 | 11/2011 | Szeremeta |
| 8,113,873 | B1 | 2/2012 | Sarraf |
| 8,133,426 | B1 | 3/2012 | Yurchenco et al. |
| 8,251,740 | B2 | 8/2012 | Grice et al. |
| 8,358,395 | B1 | 1/2013 | Szeremeta |

(Continued)

FOREIGN PATENT DOCUMENTS

CN 101567507 A 10/2009

OTHER PUBLICATIONS

International Search Report and Written Opinion dated Jul. 22, 2015 from related PCT Serial No. PCT/US2015/025446, 12 pages.

*Primary Examiner* — Joseph Feild
*Assistant Examiner* — Pameshanand Mahase

(57) ABSTRACT

An electronic device system can include an electronic device. The electronic device can include a receptacle, and a device logic driving status unit configured to generate a status signal indicating activity of the electronic device, and a communications cable. The communications cable can include a first plug configured to connect to the receptacle and receive the status signal, wherein the first plug includes a status indicator configured to indicate activity of the electronic device based on the status signal.

20 Claims, 3 Drawing Sheets

(56) References Cited

U.S. PATENT DOCUMENTS

| | | | | |
|---|---|---|---|---|
| 8,417,979 | B2 | 4/2013 | Maroney | |
| 8,462,460 | B1 | 6/2013 | Szeremeta et al. | |
| 8,498,088 | B1 | 7/2013 | Klein | |
| 8,547,658 | B1 | 10/2013 | Szeremeta | |
| 2001/0027055 | A1* | 10/2001 | Laity | H01R 13/7172 439/490 |
| 2005/0182876 | A1 | 8/2005 | Kim et al. | |
| 2005/0260884 | A1 | 11/2005 | Yueh | |
| 2007/0059975 | A1* | 3/2007 | Walsh | H01R 13/6691 439/490 |
| 2007/0141886 | A1 | 6/2007 | Hammer et al. | |
| 2007/0253168 | A1* | 11/2007 | Miller | G02B 6/4246 361/719 |
| 2008/0102689 | A1 | 5/2008 | Dhir | |
| 2008/0143185 | A1 | 6/2008 | Ingles | |
| 2008/0254663 | A1 | 10/2008 | Corona | |
| 2009/0023329 | A1 | 1/2009 | Mehnert et al. | |
| 2009/0274422 | A1 | 11/2009 | Henry et al. | |
| 2010/0002610 | A1 | 1/2010 | Bowser et al. | |
| 2010/0214107 | A1 | 8/2010 | Montebovi | |
| 2011/0069094 | A1* | 3/2011 | Knapp | G09G 3/2003 345/690 |
| 2011/0300743 | A1 | 12/2011 | Rizzo | |
| 2012/0146800 | A1 | 6/2012 | Huang et al. | |
| 2012/0298119 | A1 | 11/2012 | Reese et al. | |
| 2013/0076521 | A1 | 3/2013 | Hsu | |
| 2013/0178093 | A1 | 7/2013 | Altice et al. | |

* cited by examiner

COMMUNICATIONS CABLE WITH STATUS INDICATOR FOR ELECTRONIC DEVICES

CROSS-REFERENCE TO RELATED APPLICATIONS

This application is a continuation of and claims the benefit of priority to pending U.S. patent application Ser. No. 15/458,930 filed on Mar. 14, 2017; which is a continuation of U.S. patent application Ser. No. 14/277,362 filed on May 14, 2014, now U.S. Pat. No. 9,608,386; which claims the benefit of priority to U.S. Provisional Application No. 61/983,554 filed on Apr. 24, 2014, the entire content of all of which is incorporated by reference for all purposes as if fully set forth herein.

BACKGROUND

Conventionally, a data storage device is operated indoors. Thus, the conventional data storage device was built without the need to make it weather-resistant or weather-proof. Absent a direct intentional effort by the user to douse the data storage device in water, the data storage device may operate smoothly relative to the weather conditions within a house or building.

The data storage device is often beneficial and the user may want to use it outside a house or building. However, if there is moisture or dust, the data storage device may become damaged. This may be especially true with a hard disk drive as particles or moisture drops may damage the magnetic rotating disk located within the hard disk drive.

However, conventional methods of protecting the data storage device may be costly, cumbersome, or reduce access to the data storage device.

BRIEF DESCRIPTION OF THE DRAWINGS

The features and advantages of the present embodiments will become more apparent from the detailed description set forth below when taken in conjunction with the drawings, wherein.

DETAILED DESCRIPTION

Figure 1:
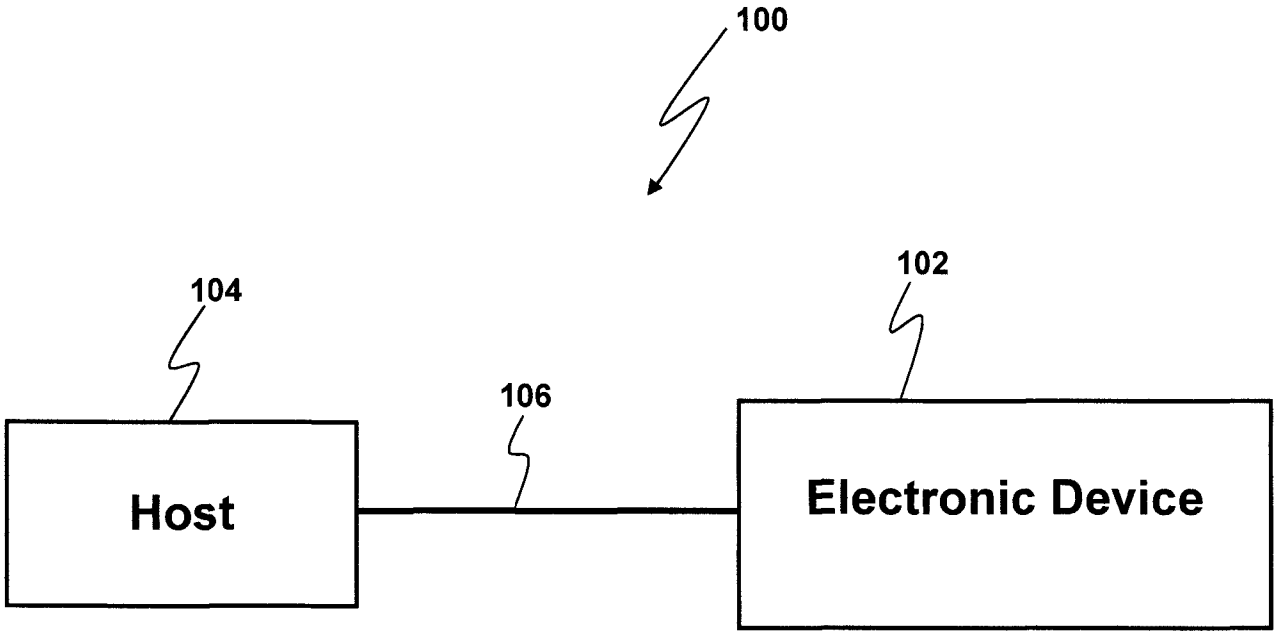
FIG. 1 depicts an electronic device system according to an embodiment.

In an embodiment, an electronic device system 100 is shown in FIG. 1. The electronic device system 100 can comprise an electronic device 102 and a communications cable 106. The communications cable 106 can connect the electronic device 102 to the host 104. The host 104 can comprise, for example, a laptop, a computer, or other device which may need to store data in the electronic device 102. In an embodiment, the host 104 can comprise a host processor and also an operating system.

In an embodiment, the electronic device 102 can comprise a portable device such as a data storage device, a battery, a power supply, or any other device comprising electronic components which are portable. In an embodiment, the data storage device comprises a direct attached storage ("DAS") device, or a network attached storage ("NAS") device. The data storage device can also comprise a magnetic rotating disk, a solid state memory, or any combination thereof.

While the description herein refers to solid state memory generally, it is understood that solid state memory may comprise one or more of various types of solid state non-volatile memory devices such as flash integrated circuits, Chalcogenide RAM (C-RAM), Phase Change Memory (PC-RAM or PRAM), Programmable Metallization Cell RAM (PMC-RAM or PMCm), Ovonic Unified Memory (OUM), Resistance RAM (RRAM), NAND memory (e.g., single-level cell (SLC) memory, multi-level cell (MLC) memory, or any combination thereof), NOR memory, EEPROM, Ferroelectric Memory (FeRAM), Magnetoresistive RAM (MRAM), other discrete NVM (non-volatile memory) chips, or any combination thereof.

In an embodiment, the electronic device 102 can comprise a ruggedized electronic device which is sealed. That is, the electronic device 102 can be weather-resistant or weather-proof. In an embodiment, when the electronic device 102 is weather-resistant or weather-proof, the electronic device 102 can utilize a weather-resistant or a weather-proof seal. For example, the electronic device 102 can be sealed such that it resists or prevents moisture entry into the electronic device 102. In an embodiment, the electronic device 102 can be sealed such that it resists or prevents dust or other foreign objects from entering into the electronic device 102. For example, the electronic device 102 can be dipped in a rubber solution to aid in sealing the electronic device 102.

The ruggedization of the electronic device 102 may be beneficial for users which seek to use the electronic device 102 in non-traditional settings. That is, settings outside the home. For example, the electronic device 102 may be utilized outdoors which are prone to exposure to the elements. Such uses may include data transfers from a movie shoot, data transfer from a photo shoot, uses at a beach, uses during combat excursions, uses while camping, or other uses which may not be within the safety of a structure to protect the electronic device 102 from the elements.

Figure 2:
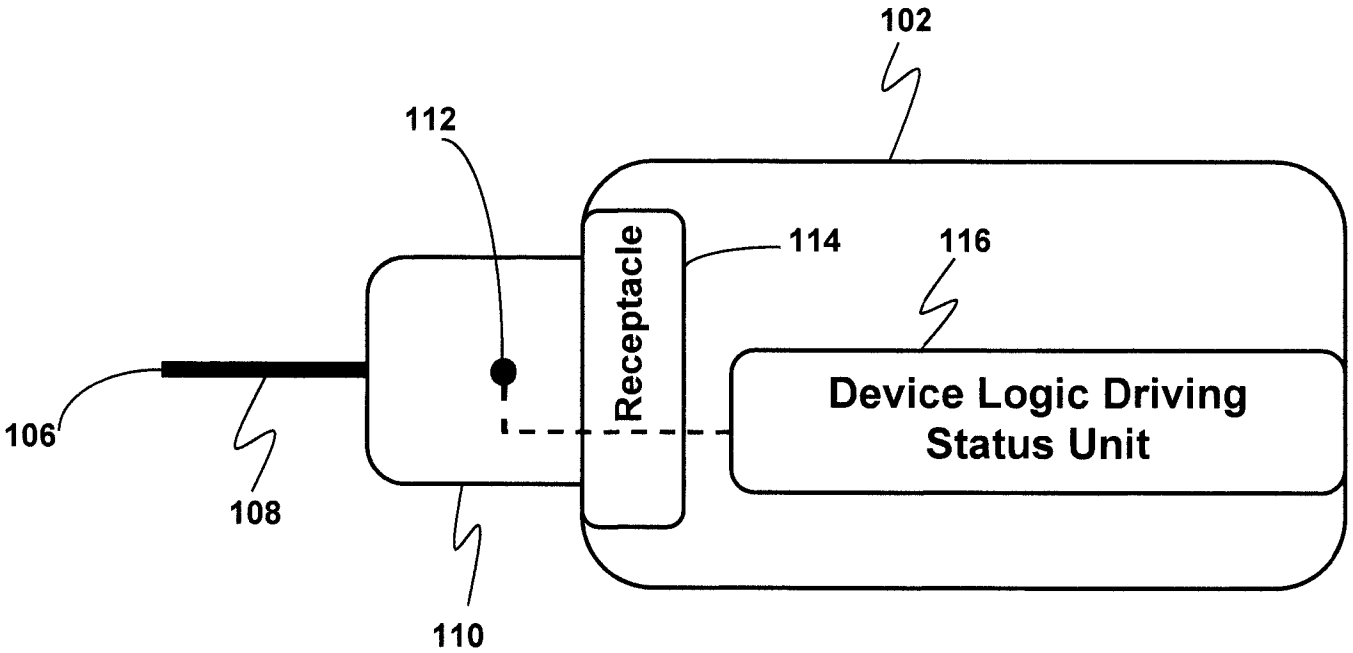
FIG. 2 depicts an electronic device connected to a communications cable according to an embodiment.

In an embodiment shown in FIG. 2, the electronic device 102 comprises a receptacle 114 configured to mate with a first plug 110 in a first end of the communications cable 106. While the receptacle 114 is shown as being located inside a housing of the electronic device 102, the receptacle 114 can also be connected via a cable to extend a distance away from the electronic device 102. The cable can be part of or unitary with the electronic device 102.

The receptacle 114 can also comprise one or more pins which are sealed. That is, the receptacle 114 can also be weather-resistant or weather-proof. In an embodiment, when the receptacle 114 is weather-resistant or weather-proof, the receptacle 114 can utilize a weather-resistant or a weather-proof seal. For example, the receptacle 114 can be sealed such that it resists or prevents moisture entry into the electronic device 102. In an embodiment, the receptacle 114 can be sealed such that it resists or prevents dust or other foreign objects from entering into the electronic device 102. Should the receptacle 114 be connected via a cable to the housing of the electronic device 102, the cable and the connection between the cable and the housing of the electronic device 102 can also be weather-resistant or weather-proof In an embodiment, the electronic device 102 can comprise a device logic driving status unit 116, light emitting diode ("LED") located within the housing of the electronic device, a light pipe, or any combination thereof, which will be described in more detail later.

The communications cable 106 can be configured to transfer data to the electronic device 102 and from the electronic device 102. In an embodiment, the communications cable 106 can comprise a universal serial bus ("USB") interface, a Thunderbolt interface, a serial ATA ("SATA") interface, a serial attached small computer system interface ("SAS"), or other types of interfaces which utilizes other transfer protocols. In an embodiment, the communications cable 106 can also be configured to connect to the host 104, such as through a second plug in a second end of the communications cable 106.

The first plug 110 and the second plug can be connected, for example, through a cable unit 108. In an embodiment, the cable unit 108 can comprise one or more copper cables, one or more fiber optic cables, or one or more types of cables which are capable of transmitting data between the first plug 110 and the second plug. Thus, the communications cable 106 can be configured to connect between the electronic device 102 and the host 104.

In an embodiment, the first plug 110 of the communications cable 106 can also comprise one or more pins which are sealed. That is, the first plug 110 can also be weather-resistant or weather-proof. In an embodiment, when the first plug 110 is weather-resistant or weather-proof, the first plug 110 can utilize a weather-resistant or a weather-proof seal. For example, the first plug 110 can be sealed such that it resists or prevents moisture entry into the communications cable 106. In an embodiment, the first plug 110 can be sealed such that it resists or prevents dust or other foreign objects from entering into the communications cable 106.

Furthermore, when the first plug 110 mates or cooperates with the receptacle 114, such a connection can also be weather-resistant or weather-proof. In an embodiment, when the connection is weather-resistant or weather-proof, the connection can utilize a weather-resistant or a weather-proof seal. For example, the connection can be sealed such that it resists or prevents moisture entry into the communications cable 106 or the electronic device 102. In an embodiment, the connection can be sealed such that it resists or prevents dust or other foreign objects from entering into the communications cable 106 or the electronic device 102.

In an embodiment, the communications cable 106 can comprise a status indicator 112 located on the first plug 110 which connects to the electronic device 102. The status indicator 112 can be configured to indicate a status of the electronic device 102. The status of the electronic device 102 can include, for example, activity of the electronic device 102, temperature data of the electronic device 102, a shock indication for shock applied to the electronic device 102, health indication of the electronic device 102, error indications of the electronic device 102, or other types of information about the electronic device 102.

In an embodiment, the status indicator 112 can comprise one or more lights, such as one or more LEDs. The one or more lights can also be varied in color. In such a case, activating or deactivating the LEDs can indicate the status of the electronic device 102. For example, activating the LEDs can indicate a first status of the electronic device 102 while deactivating the LEDs can indicate a second status of the electronic device 102 different than the first status. Furthermore, the LEDs can also have various colors to indicate the various statuses of the electronic device 102.

In an embodiment, the status indicator 112 indicates the status of the electronic device 102 based on a status signal from the device logic driving status unit 116 in the electronic device. In an embodiment the status signal can be transmitted through one or more of the pins for one of the protocols for the interfaces disclosed above. However, in an embodiment, the status signal can also be sent in a pin which has been added in addition to the pins for one of the protocols for the interfaces disclosed above. In the case where the status indicator 112 comprises a LED, the LED will then turn on or off based on the status signal from the device logic driving status unit 116. In an embodiment, the device logic driving status unit 116 can comprise a controller for the electronic device 102.

In an embodiment, the device logic driving status unit 116 is configured to detect when the first plug 110 is connected to the receptacle 114. When the device logic driving status unit 116 detects that the first plug 110 is connected to the receptacle 114, the device logic driving status unit 116 commences transmission of the status signal to the status indicator 112.

This can reduce the manufacturing cost of the electronic device 102 since the electronic device 102 is ruggedized. By reducing the amount of holes or weak spots in the housing of the electronic device 102, such as an LED or lens for the LED on an external portion of the housing, the housing can be more easily manufactured. For example, if there were holes or weak spots in the housing, such holes or weak spots may need to be reinforced with gaskets, sealant or other types of materials which can aid in preventing water or other foreign objects from entering the electronic device 102. Thus, the absence or reduction in the number of holes or weak spots in the housing can reduce the manufacturing cost of the electronic device 102.

Figure 3:
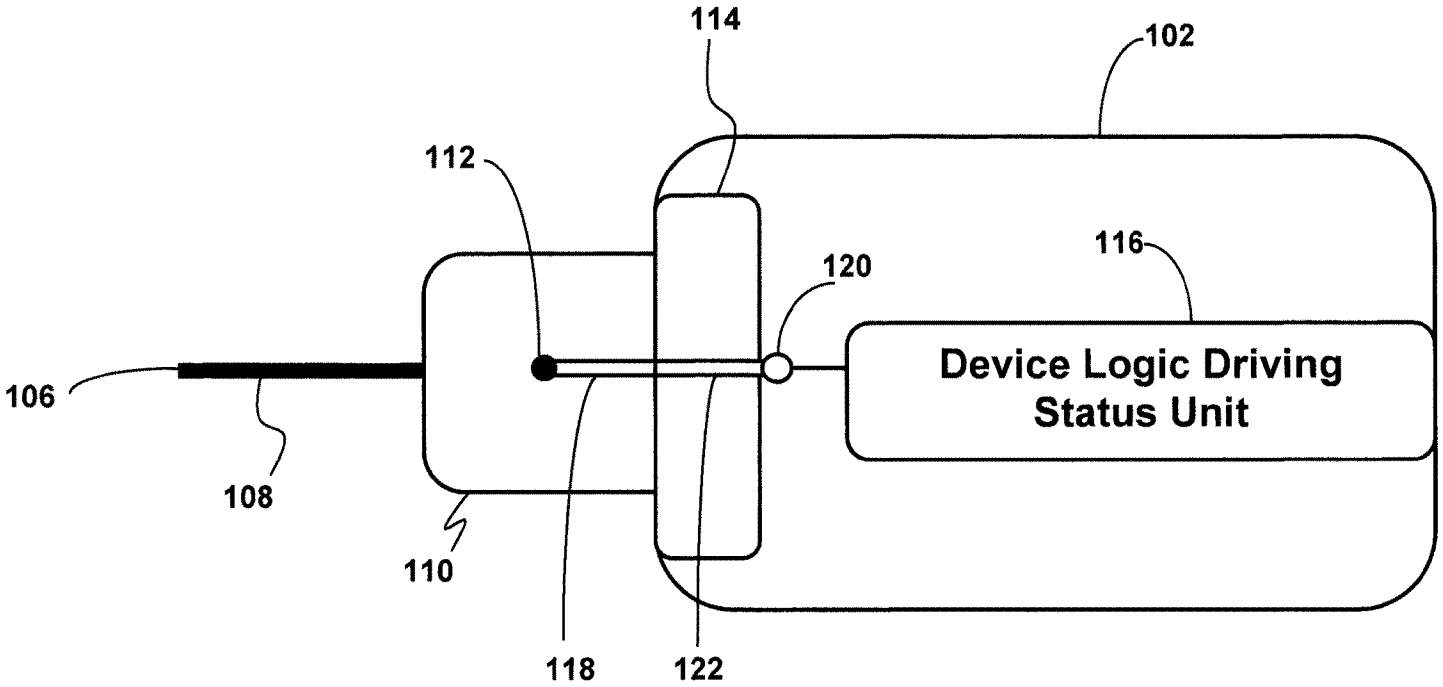
FIG. 3 depicts an electronic device connected to a communications cable according to an embodiment.

In an embodiment shown in FIG. 3, the status indicator 112 comprises a first light pipe 118. In such a case, the electronic device 102 can comprise one or more LEDs 120 and a second light pipe 122. The second light pipe 122 is configured to cooperate with the first light pipe 118 to ensure transmission of the light from the one or more LEDs 120 located in the electronic device 102 to the status indicator 112.

Thus, the light from the one or more LEDs 120 located in the electronic device 102 will be visible on the first plug 110, even without the first plug 110 comprising an LED. In an embodiment, the first light pipe 118 can reflect the light from the one or more LEDs 120 so that the light from the one or more LEDs 120 is visible on the first plug 110. In an embodiment, the status signal will thus comprise the light from the one or more LEDs 120. In an embodiment, the first light pipe 118 can comprise one or more mirrors to aid in reflecting the light from the one or more LEDs 120.

Since the one or more LEDs 120 are located within the electronic device 102, this also reduces an amount of holes or weak spots in the housing of the electronic device 102. The second light pipe 122 may be easier to seal or weather-proof than a LED or a LED lens that is exposed in an exterior of the housing (as opposed to being located inside the housing). In addition, the second light pipe 122 can also be located within the connection between the communications cable 106 and the electronic device 102 so additional sealing or weather-proofing may not be necessary.

Furthermore, should the communications cable 106 be damaged due to a breach from the status indicator 112, replacement of the communications cable 106 will be relatively inexpensive compared with replacement of the electronic device 102. Furthermore, a user will be able to have multiple communications cable 106 available and a replacement communications cable 106 will result in little down time. In addition, the data stored in the electronic device 102 will not be lost or inaccessible for long periods of time.

In an embodiment, the first plug 110 can comprise a translucent material to allow the status indicator 112 to be more visible to a user. For example, all of the first plug 110 can comprise a translucent material. In such a case, portions of the first plug 110 can be painted or coated over to restrict visibility to other internal components of the first plug 110, while allowing the status indicator 112 to be visible to the user. However, the first plug 110 need not be painted or coated. Alternatively, only portions of the first plug 110 can comprise a translucent material to restrict visibility to other internal components of the first plug 110, while allowing the status indicator 112 to be visible to the user.

In an embodiment, the status indicator 112 need not be located just in the first plug 110. Instead, the status indicator 112 or portions of the status indicator 112 can be located in the cable unit 108, the second plug, or any combination thereof. Furthermore, if at least a portion of the status indicator 112 is located in the cable unit 108, portions of the cable unit 108 can comprise a translucent material to allow the status indicator 112 to be more visible to a user.

Those of ordinary skill would appreciate that the various illustrative logical blocks, modules, and algorithm parts described in connection with the examples disclosed herein may be implemented as electronic hardware, computer software, or combinations of both. Furthermore, the embodiments can also be embodied on a non-transitory machine readable medium causing a processor or computer to perform or execute certain functions.

To clearly illustrate this interchangeability of hardware and software, various illustrative components, blocks, modules, circuits, and process parts have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the disclosed apparatus and methods.

The parts of a method or algorithm described in connection with the examples disclosed herein may be embodied directly in hardware, in a software module executed by a processor, or in a combination of the two. The parts of the method or algorithm may also be performed in an alternate order from those provided in the examples. A software module may reside in RAM memory, flash memory, ROM memory, EPROM memory, EEPROM memory, registers, hard disk, a removable disk, an optical disk, or any other form of storage medium known in the art. An exemplary storage medium is coupled to the processor such that the processor can read information from, and write information to, the storage medium. In the alternative, the storage medium may be integral to the processor. The processor and the storage medium may reside in an Application Specific Integrated Circuit (ASIC).

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the disclosure is, therefore, indicated by the appended claims rather than by the foregoing description. All changes which come within the meaning and range of equivalency of the claims are to be embraced within their scope.

What is claimed is:

1. A system comprising:

a storage device comprising:

a receptacle, and a device logic driving status unit; and a communications cable comprising:

a cable unit, a first plug coupled to one end of said cable unit and configured to connect to said receptacle, and a second plug coupled to another end of said cable unit and communicatively coupled to said device logic driving status unit of said storage device via said cable unit and said first plug, wherein said second plug comprises a status indicator driven by a status signal received from said storage device;

wherein said device logic driving status unit is further configured to detect whether said first plug is connected to said receptacle and to responsively commence transmission of said status signal to the status indicator of said second plug.

2. The system of claim 1, wherein said storage device is weather-resistant.

3. The system of claim 1, wherein said storage device is weatherproof.

4. The system of claim 1, wherein said storage device further comprises a weather-resistant seal.

5. The system of claim 1, wherein said storage device further comprises a weatherproof seal.

6. The system of claim 1, wherein a connection formed by said first plug of said communications cable connecting to said receptacle of said storage device is weather-resistant.

7. The system of claim 1, wherein a connection formed by said first plug of said communications cable connecting to said receptacle of said storage device is weatherproof.

8. The system of claim 1, wherein said receptacle of said storage device comprises a weather-resistant or weatherproof seal.

9. The system of claim 1, wherein said first plug of said communications cable comprises a weather-resistant or weatherproof seal.

10. A system comprising:

a storage device comprising:

a housing, a receptacle coupled to said housing via a first cable unit, and a device logic driving status unit; and a communications cable comprising:

a second cable unit, and a first plug coupled to one end of said second cable unit and configured to connect to said receptacle and communicatively coupled to said device logic driving status unit of said storage device, wherein said first plug comprises a status indicator driven by a status signal received from said storage device;

wherein said device logic driving status unit is further configured to detect whether said first plug is connected to said receptacle and to responsively commence transmission of said status signal to the status indicator of said first plug.

11. The system of claim 10, wherein said storage device is weather-resistant.

12. The system of claim 10, wherein said storage device is weatherproof.

13. The system of claim 10, wherein said storage device further comprises a weather-resistant seal.

14. The system of claim 10, wherein said storage device further comprises a weatherproof seal.

15. The system of claim 10, wherein a connection formed by said first plug of said communications cable connecting to said receptacle of said storage device is weather-resistant.

16. The system of claim 10, wherein a connection formed by said first plug of said communications cable connecting to said receptacle of said storage device is weatherproof.

17. The system of claim 10, wherein said receptacle of said storage device comprises a weather-resistant or weatherproof seal.

18. The system of claim 10, wherein said first plug of said communications cable comprises a weather-resistant or weatherproof seal.

19. The system of claim 10, wherein said first cable unit is weather-resistant or weatherproof.

20. The system of claim 10, wherein a connection formed by said first cable unit coupling to said housing of said storage device is weather-resistant or weatherproof.

* * * * *